US005940918A

United States Patent [19]

Binette

[11] Patent Number: 5,940,918

[45] Date of Patent: Aug. 24, 1999

[54] APPARATUS FOR CLEANING A GOLF HEAD

[76] Inventor: Marc R. Binette, 124 Long Hill Dr., Glastonbury, Conn. 06033

[21] Appl. No.: 08/881,863

[22] Filed: Jun. 24, 1997

[51] Int. Cl.[6] ..... A63B 57/00

[52] U.S. Cl. ..... 15/21.1; 15/88.3; 15/104.92

[58] Field of Search ..... 15/21.1, 104.92, 15/34, 88.3, 88.4, 88.2, 36, 21.2, 77, 3

[56] References Cited

U.S. PATENT DOCUMENTS

| | | | |
|---|---|---|---|
| 3,055,029 | 9/1962 | Maetzold | 15/21.1 |
| 3,332,099 | 7/1967 | Reiter | 15/21.1 |
| 3,619,841 | 11/1971 | Russell et al. | 15/21.1 |
| 3,648,315 | 3/1972 | Hash | 15/4 |
| 3,704,475 | 12/1972 | Brooks | 15/88.4 |
| 3,831,217 | 8/1974 | Odawora | 15/36 |
| 3,872,534 | 3/1975 | Hoag | 15/21 |
| 3,994,040 | 11/1976 | DiStefano | 15/236 |
| 4,180,884 | 1/1980 | Hess et al. | 15/21.1 |
| 4,233,705 | 11/1980 | Lepage et al. | 15/104.92 |
| 4,676,839 | 6/1987 | Osborn | 15/21.51 |
| 4,872,232 | 10/1989 | Stiasny | 15/21 |
| 4,951,339 | 8/1990 | Braun | 15/88.4 |
| 4,958,396 | 9/1990 | Butler et al. | 15/88.4 |
| 4,965,906 | 10/1990 | Mauro | 15/104.92 |
| 5,054,153 | 10/1991 | Silliman | 15/160 |
| 5,155,883 | 10/1992 | Legault | 15/21.2 |
| 5,253,383 | 10/1993 | Clark | 15/34 |
| 5,560,065 | 10/1996 | McDivitt | 15/21.1 |
| 5,742,965 | 4/1998 | Leask | 15/21.1 |

*Primary Examiner*—Gary K. Graham
*Attorney, Agent, or Firm*—McCormick, Paulding & Huber LLP

[57] ABSTRACT

In an apparatus for cleaning a golf club head, a brush having a plurality of bristles is rotatably mounted on a housing. Within the housing are two lateral support surfaces spaced apart from each other and defining a channel therebetween for receiving and retaining the golf club head. The bristles of the brush define an arcuate path of movement extending along at least a portion of the channel, and thus the bristles engage the face of the club received within the channel. As the brush rotates it removes dirt and other debris from the face of the club. Preferably, there is also a brush-engaging surface, such as a ledge, which projects into the arcuate path of movement of the bristles. The brush-engaging surface engages the bristles upon rotation of the brush, thereby dislodging dirt and other debris from the bristles.

11 Claims, 4 Drawing Sheets

APPARATUS FOR CLEANING A GOLF HEAD

FIELD OF THE INVENTION

The present invention relates to apparatus for cleaning golf clubs, and more specifically to apparatus for cleaning the ball-striking face of a golf club head.

BACKGROUND OF THE INVENTION

A typical golf club comprises a head having a ball-striking face, a shaft connected at one end to the head, and a grip connected to the other end of the shaft for gripping and swinging the club. As a golfer proceeds across a golf course during a game, the golf club head tends to accumulate dirt and other debris on its ball-striking face from continued contact with the golf ball and ground. The accumulated dirt and debris can reduce a golfer's ability to accurately strike and move a ball in the intended manner. Accordingly, it is desirable to periodically clean the ball-striking face of the club head, particularly before and during a golf game.

Most devices for cleaning golf club heads are relatively complex and include many mechanical and/or electrical components. Each of the many components may wear out, rust or otherwise fail with repeated use. Furthermore, such devices typically cannot be easily repaired by the golfer using the device, but must instead be repaired by a specialist with knowledge of the device. An apparatus for cleaning a golf club head would preferably include a relatively lesser number of components, and an even lesser number of components which are susceptible to wear, rust or failure.

The ball-striking face of a golf club head typically defines a plurality of parallel grooves spaced relative to each other for affecting and/or controlling ball spin. Dirt and other debris become lodged in the groove, and cannot be easily removed without scraping within the groove. Although a specialized tool, such as a multi-pronged scraper, may be able to clean the grooves, such tools are typically not effective for cleaning the entire ball-striking face.

The prior art apparatus for cleaning golf club heads, such as those disclosed in U.S. Pat. No. 4,951,339 to Braun and U.S. Pat. No. 3,332,099 to Reiter, typically include a rotating brush for contacting the club head and removing dirt and debris. The brush tends to accumulate the dirt and other debris removed from the club head. With repeated use, the brush can become unable to clean effectively and may even add to the accumulated filth on a club head. It is therefore necessary to periodically remove the apparatus from service and clean or replace the brush. Accordingly, an apparatus for cleaning a golf club head ideally would also be able to clean itself without requiring removal of the brush or like cleaning member.

Other prior art apparatus for cleaning golf club heads require a golfer to hold the club in place or even move and/or rotate the club to thoroughly clean its head. It would be advantageous, however, if an apparatus for cleaning a golf club head would secure the club in place during a cleaning operation and thereby free the golfer's hand for other use. Furthermore, golf clubs are adapted for use by either left-handed or right-handed players depending on the location of the ball-striking face on the head. Thus, such an apparatus which retains a club in place during a cleaning operation would ideally also be able to secure both left-handed and right-handed golf clubs in an orientation which allows the ball-striking face to be cleaned. The present inventor is not aware of any commercially-available apparatus which fixes a club in place while the head is cleaned, much less such an apparatus which fixes both left-handed and right-handed golf clubs in an appropriate orientation for cleaning the ball-striking face.

An apparatus for cleaning a golf club head is preferably located outdoors on a golf course so that golfers may clean their clubs while they play. The apparatus therefore should also be able to withstand the effects of prolonged and repeated exposure to sunlight, precipitation and temperature variations.

Accordingly, it is an object of the present invention to provide an apparatus for cleaning the ball-striking face of a golf club head which overcomes some or all of the drawbacks and disadvantages of the above-described prior art apparatus.

SUMMARY OF THE INVENTION

The present invention is directed to an apparatus for cleaning the ball-striking face of a golf club head, comprising a housing and a brush rotatably mounted on the housing and including a plurality of bristles. Within the housing are formed two lateral support surfaces spaced apart from each other and defining a channel therebetween for receiving and retaining the club head with its ball-striking face oriented toward the brush. The bristles of the brush define an arcuate path of movement extending along at least a portion of the channel for engaging with the bristles the ball-striking face and removing dirt and other debris therefrom upon rotation of the brush.

Preferably, a brush-engaging surface is formed at the base of the channel and projects into the arcuate path of movement of the bristles. The brush-engaging surface engages the bristles upon rotation of the brush, thereby dislodging dirt and other debris from the bristles. Thus, in contrast to the above-described prior art apparatus, the brush is substantially self-cleaning and may be used for longer periods of time without being removed for cleaning.

In a preferred embodiment of the invention, the apparatus includes two channels, each for receiving and retaining a club head. One channel receives and retains a left-handed club head inserted therein and the other channel receives and retains a right-handed club head inserted therein. Each channel orients the ball-striking face of the respective club head toward the brush and retains and thereby secures the desired position of the club head throughout each cleaning operation.

One advantage of the apparatus of the present invention is that the two lateral support surfaces prevent lateral movement of a club received within the channel. Thus, the club is secured in the desired cleaning position and need not be manually held during a cleaning operation.

Other advantages of the present invention will become apparent in view of the following detailed description and accompanying drawings.

DESCRIPTION OF PREFERRED EMBODIMENT

Figure 1:
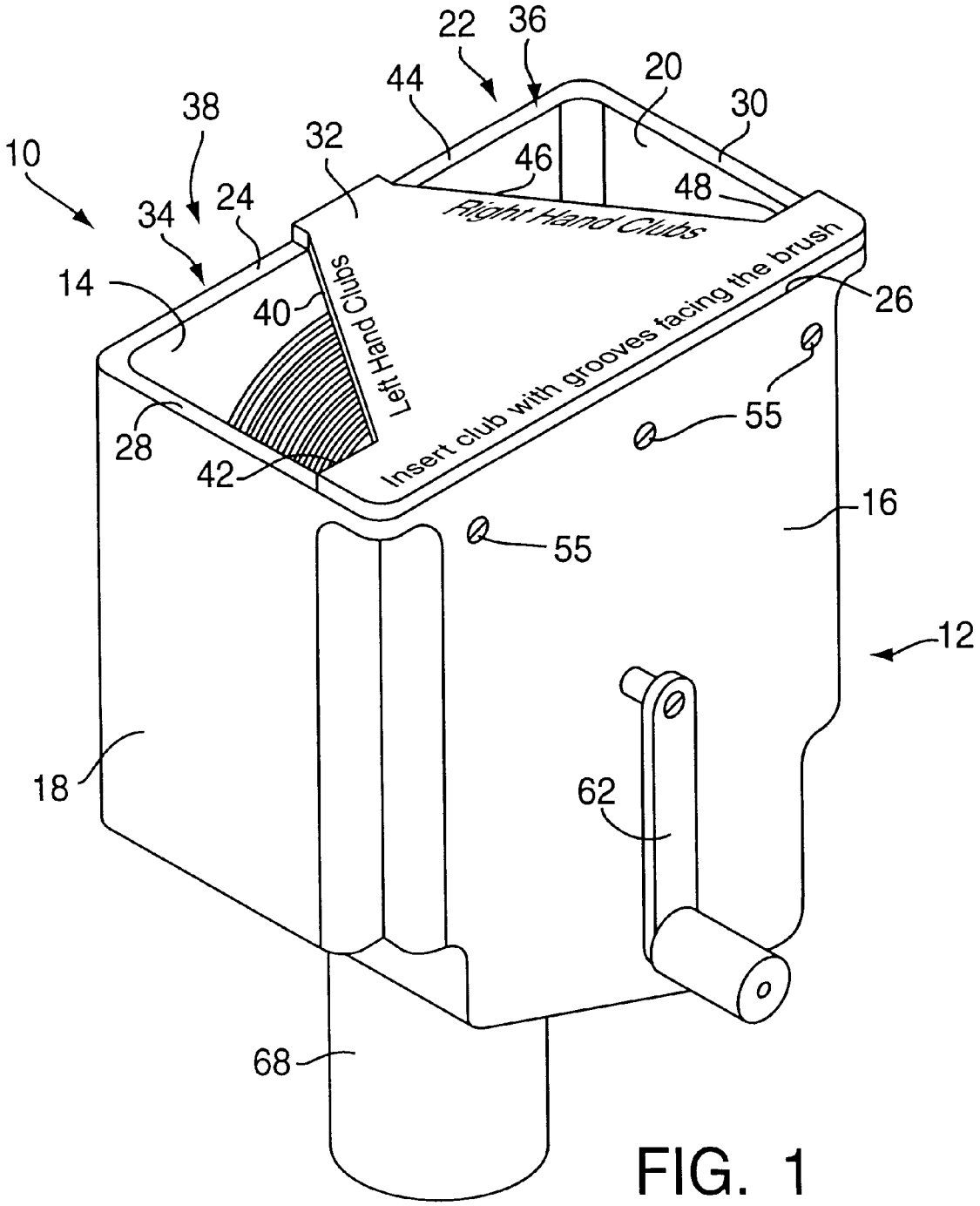
FIG. 1 is a perspective view of an apparatus embodying the present invention for cleaning a golf club head.

In FIG. 1, an apparatus embodying the present invention for cleaning a golf club head is indicated generally by the reference numeral 10. The apparatus 10 includes a hollow housing 12 which is preferably generally rectangular and defines four side walls 14, 16, 18 and 20. The walls 14 and 16 are opposite each other, and are each contiguous with each of opposing walls 18 and 20, respectively. The housing 12 defines an upper opening 22 formed by the upper edges 24, 26, 28 and 30 of the four walls 14, 16, 18 and 20, respectively.

Figure 3:
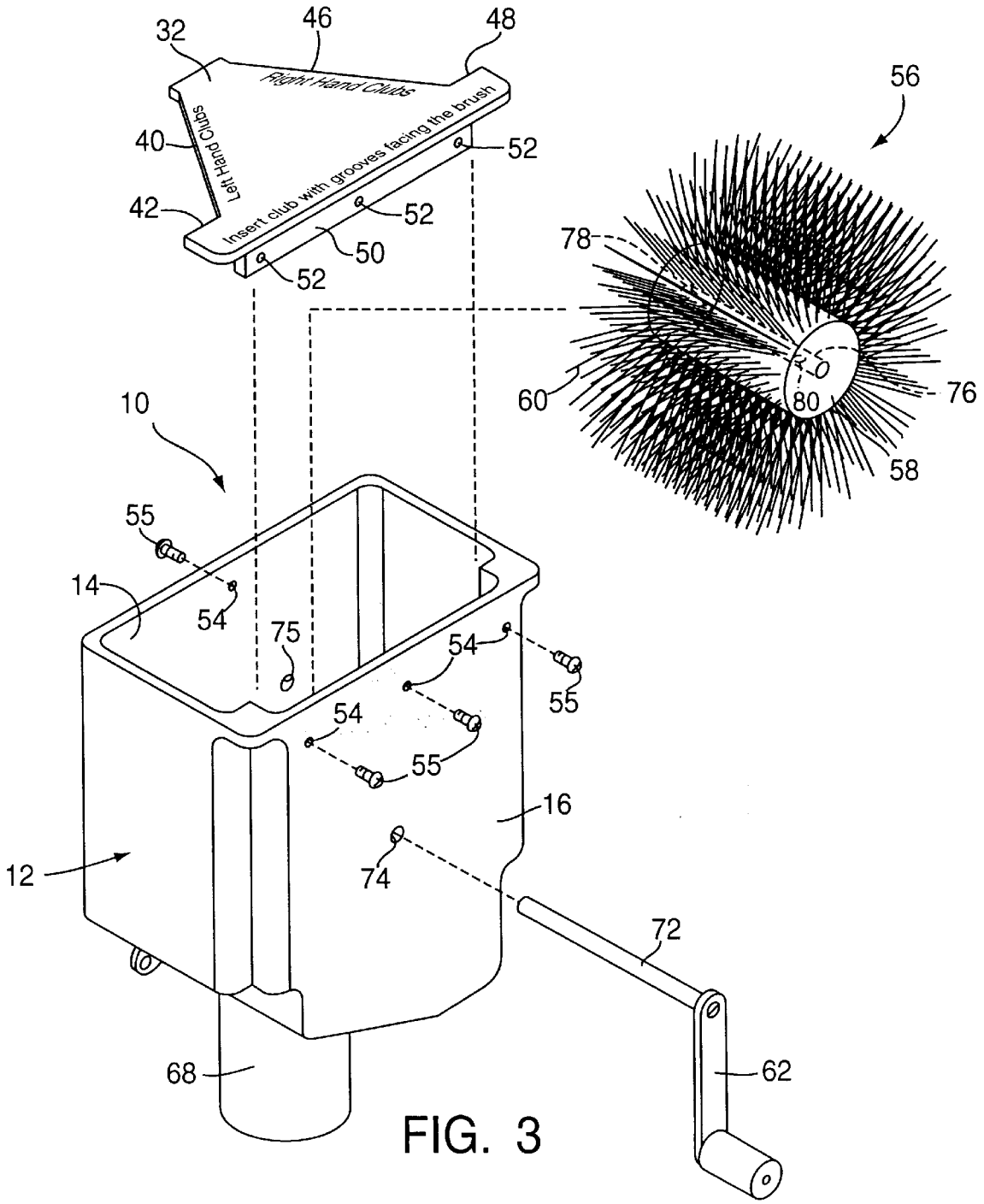
FIG. 3 is an exploded perspective view of the apparatus of FIG. 1.

A lid 32 partially covers the upper opening 22 and thereby divides the opening into a left aperture 34 and a right aperture 36. The left aperture 34 is defined by the top edge 28 of the wall 18, a left portion 38 of the top edge 24 of the wall 14, and surfaces 40 and 42 of the lid 32. The surface 40 of the lid is spaced adjacent to, and faces the junction of the walls 18 and 20, and is oriented at an acute angle relative to each of the two walls. The surface 42 extends between one end of the surface 40 and the wall 18, and is perpendicular to the wall 18. Similarly, the right aperture 36 is defined by the top edge 30 of the wall 20, a right portion 44 of the top edge 24, and surfaces 46 and 48 of the lid 32. The surface 46 is spaced adjacent to, and faces the junction of the walls 14 and 20, and is oriented at an acute angle relative to each of the two walls. The surface 48 extends between end one of the surface 46 and the wall 20, and is perpendicular to the wall 20. As shown in FIG. 3, a pair of depending flanges 50 are formed on opposite sides of the lid 32 relative to each other (only one shown), and each flange defines one or more apertures 52. Similarly, the housing 12 defines corresponding apertures 54 formed in the walls 14 and 16 for receiving threaded fasteners 55 in order to removably attach the lid to the housing.

The housing 12 is formed of a durable material, such as plastic, so that the apparatus may withstand prolonged and repeated exposure to precipitation and temperature variations. The housing 12 is preferably formed of a material which is also resistant to ultra-violet radiation so that the apparatus 10 may remain outdoors without significant degradation due to prolonged exposure to sunlight.

Figure 2:
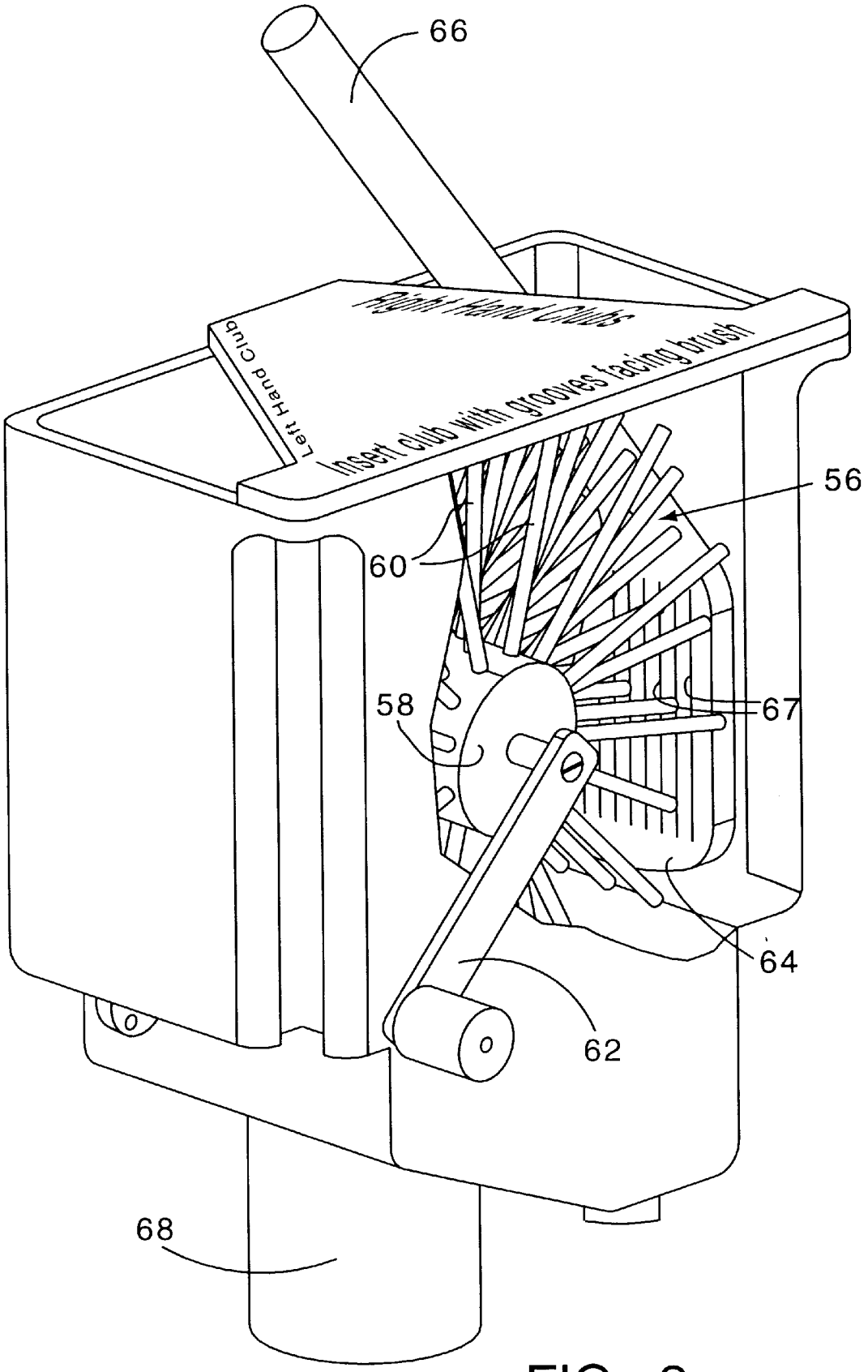
FIG. 2 is a cutaway perspective view of the apparatus of FIG. 1 and illustrating a typical golf club head received within the channel for cleaning the ball-striking face with rotation of the brush.

Referring to FIG. 2, a brush 56 is rotatably mounted within the hollow interior of the housing 12. The brush 56 includes a cylindrical core 58 and a plurality of bristles 60 which are each mounted on one end to the core, extend radially therefrom, and are circumaxially spaced relative to each other about the core. As is described further below, the core 58 is connected to a handle 62 (also shown in FIG. 1) for rotating the core to thereby move the bristles 60 along an arcuate path of movement for cleaning the ball-structure face of the club(s).

As shown in FIG. 3, the handle 62 is connected to one end of a shaft 72, and the shaft is slidably received through opposing apertures 74 and 75 (FIG. 4) formed through the walls 16 and 14, respectively, of the housing 12. The core 58 of the brush define an axially-elongated bore 76 for receiving the shaft 72 and thereby rotatably mounting the brush within the housing. A pair of set screws 78 and 80 are threadially received through the core 58 to engage the shaft 72 in order to fixedly secure the core to the shaft and thereby permit rotation of the brush with the handle.

Referring again to FIG. 1, a cylindrical connector 68 for attaching the housing 12 to a post (not shown) or other types of support is formed by the housing and extends downwardly from the base.

Figure 4:
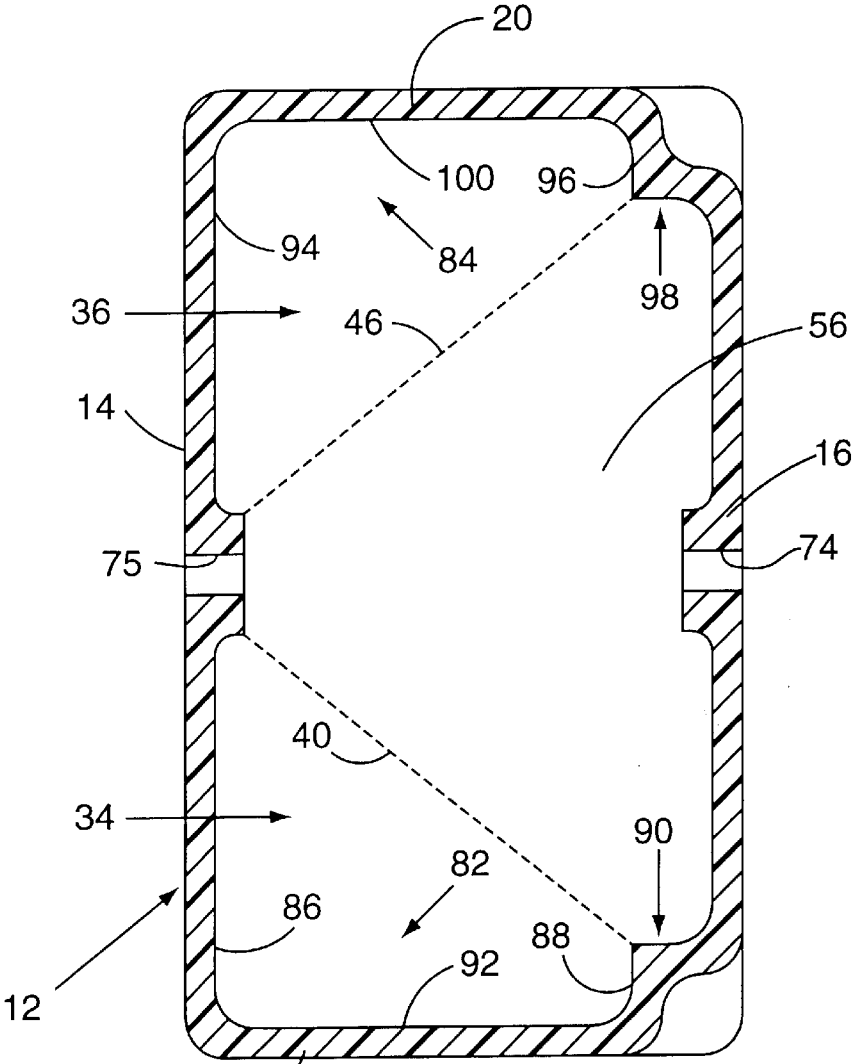
FIG. 4 is a top plan view of a housing of the apparatus of FIG. 1 with parts removed for clarity.

Referring to FIG. 4, the housing 12 defines a left channel 82 and a right channel 84, each for receiving and retaining a club head inserted therein. The left channel 82 is defined by a first lateral support surface 86 formed by the interior surface of the wall 14, and a second lateral support surface 88 spaced apart from the first lateral support surface 86 and defined by an interior protrusion 90 projecting inwardly at the junction of the walls 16 and 18.

A base surface 92 extends between the lateral support surfaces 86 and 88 for contacting and supporting the back side, or side of the club head formed opposite to the ball-striking face. As shown in FIG. 1, the surface 40 of the lid is oriented at an acute angle relative to the base surface 92 for contacting and supporting a shaft (not shown in FIG. 4) connected to the club head received within the channel 82.

The ball-striking face 64 (FIG. 2) of the club head typically defines a plurality of approximately parallel grooves 67 spaced relative to each other. The lateral support surfaces 86 and 88 retain a club head (not shown) which is inserted into the channel 82 through the left aperture 34 formed (FIG. 1). Preferably, the lateral support surfaces 86 and 88 are elongated surfaces (longer in the vertical direction than in the lateral direction extending between the lateral support surfaces) defining an elongated channel for receiving and retaining approximately the entire club head.

The channel 82 orients the ball-striking face of the club head received therein towards the brush 56, with the grooves of the ball-striking face substantially coincident with the arcuate path of movement of the bristles 60. Thus, the bristles 60 remove dirt and other debris from the grooves. The bristles 60 are furthermore spaced relative to each other across approximately the entire width of the channel 82 for engaging at least approximately the entire ball-striking face of the club head received therein to thereby clean the entire face.

The left channel 82 is adapted to receive left-handed clubs, whereas the right channel 84 is located on an opposite side of the brush 56 relative to the channel 82 and is adapted to receive right-handed clubs. The right channel 84 is defined by a first lateral support surface 94 formed by the interior surface of the wall 14, and a second lateral support surface 96 spaced apart from the first lateral support surface 94 and defined by an interior protrusion 98 projecting inwardly at the junction of the walls 16 and 20.

A base surface 100 extends between the lateral support surfaces 94 and 96 for contacting or supporting the back side. As shown in FIG. 1, the surface 46 of the lid is oriented at an acute angle relative to the base surface 100 for contacting and supporting a shaft (not shown in FIG. 4) connected to the club head received within the channel 84.

The lateral support surfaces 94 and 96 retain a club head (not shown) which is inserted into the channel 84 through the right aperture 36 formed (FIG. 1). Preferably, the lateral support surfaces 94 and 96 are elongated surfaces defining an elongated channel for receiving and retaining approximately the entire club head.

As described above with respect to the channel 82, the channel 84 orients the ball-striking face of the club head received therein towards the brush 56, with the grooves of the ball-striking face substantially coincident with the arcuate path of movement of the bristles 60 of the brush 56. Thus, the bristles 60 remove dirt and other debris from the grooves. The bristles 60 are furthermore spaced relative to each other across approximately the entire width of the channel 84 for engaging at least approximately the entire ball-striking face of the club head received therein to thereby clean he entire face.

Figure 5:
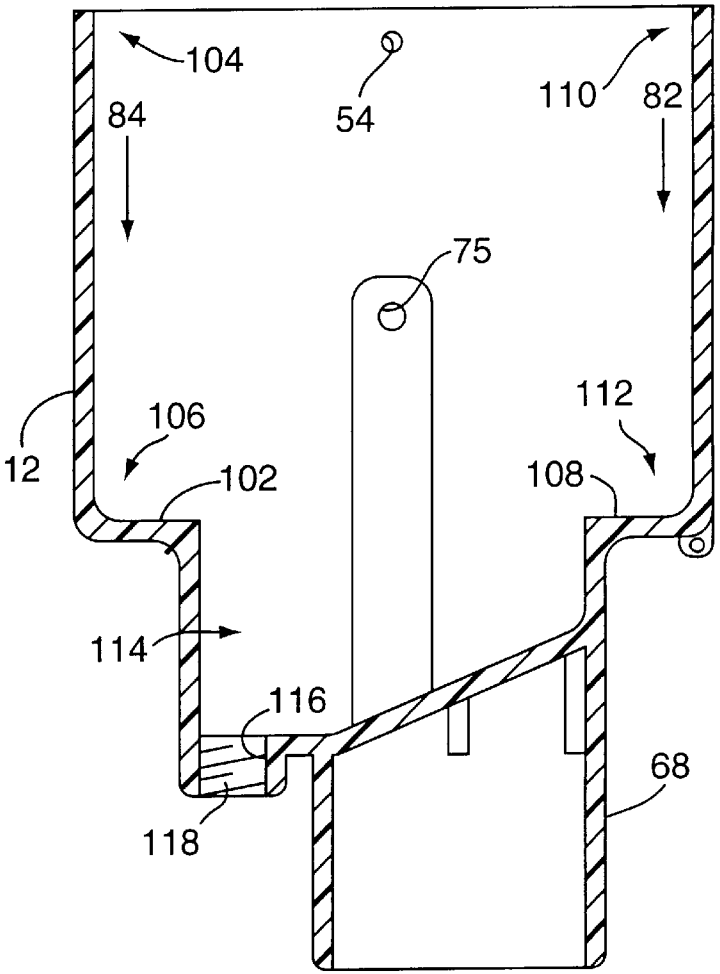
FIG. 5 is a side elevational view of the housing taken from the left side of FIG. 1.

Turning now to FIG. 5, the housing 12 defines a left brush-engaging surface 102, such as a ledge, projecting into the arcuate path of movement of the bristles. The brush-engaging surface 102 engages the bristles upon rotation of the brush for dislodging dirt and other debris therefrom. Preferably, the channel 84 defines an upper end 104 and a lower end 106, and the brush-engaging surface 102 is formed at the lower end 106 of the channel 84 for contacting and supporting a respective side of a club head (not shown in FIG. 5) received within the channel 84.

The housing 12 further defiles a right brush-engaging surface 108 also projecting into the arcuate path of movement of the bristles. The right channel 82 defines an upper end 110 and a lower end 112, and the right brush-engaging surface 108 is formed at the lower end 112 of the channel 82 for contacting and supporting a respective side of a club head (not shown in FIG. 5) received within the channel 82.

Preferably, cleaning fluid, such as a solution of water and a detergent, is introduced into the housing 12 for facilitating the cleaning of the club heads. Accordingly, the housing 12 further defines a reservoir 114 below the brush for receiving and retaining the cleaning fluid. The cleaning fluid is introduced into the housing 12 through the left aperture 34 (FIG. 1) and/or the right aperture 36 (FIG. 1), thereby washing dirt and other debris from the club head and brush bristles as the brush rotates and accumulating in the reservoir 114. An aperture 116 in the reservoir is sealed with a plug 118, which is removed to drain the fluid from the reservoir during or after a cleaning operation.

Although the invention has been shown and described with respect to a preferred embodiment thereof, it will be understood by those skilled in the art that other various changes, omissions and additions thereto may be made without departing from the spirit and scope of the present invention.

What is claimed is:

1. An apparatus for cleaning a golf club head having a ball-striking face, comprising:

a housing including a first lateral support surface and a second lateral support surface and defining a first channel therebetween for receiving and retaining the club head wherein the first channel defines an upper end and a lower end;

a brush rotatably mounted on the housing and including a plurality of bristles defining an arcuate path of movement extending along at least a portion of the first channel for engaging with the bristles the ball-striking face of the club received within the first channel and removing dirt and other debris therefrom; and a brush-engaging surface projecting into the arcuate path of movement and formed at the lower end of the first channel for contacting and supporting a respective side of the club head received within the first channel, and wherein the brush-engaging surface contacts the bristles upon rotation of the brush to dislodge dirt and other debris therefrom.

2. The apparatus of claim 1, wherein the housing further includes a third lateral support surface and a fourth lateral support surface spaced apart from the third lateral support surface and defining a second channel therebetween for receiving and retaining a club head, and the second channel is spaced relative to the first channel and extends along a portion of the arcuate path of movement of the bristles for engaging with the bristles the ball-striking face of the club received within the second channel and removing dirt and other debris therefrom.

3. The apparatus of claim 2, wherein the second channel is located on an opposite side of the brush relative to the first channel, and the first channel is adapted to receive a left-handed golf club and the second channel is adapted to receive a right-handed golf club.

4. The apparatus of claim 2, further comprising:

a brush-engaging surface projecting into the arcuate path of movement of the bristles formed at the lower end of the second channel for contacting and supporting a respective side of the club head received within the second channel, and wherein the brush-engaging surface contacts the bristles upon rotation of the brush to dislodge dirt and other debris therefrom.

5. The apparatus of claim 1, wherein the first lateral support surface and the second lateral support surface are elongated surfaces defining an elongated channel for receiving and retaining at least approximately the entire club head.

6. The apparatus of claim 1, wherein the housing forms an aperture located at the upper end of the first channel for receiving the club head there through.

7. The apparatus of claim 6, wherein the first channel is further defined by a base surface extending between the first and second lateral support surfaces, and the aperture is defined by a surface oriented at an acute angle relative to the base surface for contacting and supporting a shaft connected to the club head received within the channel.

8. The apparatus of claim 1, further comprising a handle coupled to the brush for rotating he brush.

9. The apparatus of claim 1, wherein the bristles are spaced relative to each other across approximately the entire width of the first channel for engaging at least approximately the entire ball-striking face of the club received within the first channel.

10. The apparatus of claim 1, wherein the ball-striking face of the club head received within the first channel defines a plurality of approximately parallel grooves spaced relative to each other, and the first channel is oriented relative to the arcuate path of movement of the bristles so that the grooves are substantially coincident with the arcuate path of movement of the bristles across the ball-striking face, and the bristles remove dirt and other debris from the grooves.

11. The apparatus of claim 1, wherein the housing further defines a reservoir below the brush for receiving and retaining fluid introduced into the housing.

* * * * *